US005709739A

United States Patent [19]

Wittich et al.

[11] Patent Number: 5,709,739

[45] Date of Patent: Jan. 20, 1998

[54] RELEASE AGENTS FOR HYDRAULIC BINDERS

[75] Inventors: Leonhard Wittich, Lagenfeld; Stephan Heck, Pulheim; Lothar Friesenhagen, Duesseldorf; Guenther Demmering, Solingen; Horst-Dieter Komp, Langenfeld; Michael Koehler, Mettmann; Ingo Wegener, Duesseldorf; Hans-Juergen Sladek, Krefeld, all of Germany

[73] Assignee: Henkel Kommanditgesellschaft auf Aktien, Duesseldorf, Germany

[21] Appl. No.: 666,496

[22] PCT Filed: Dec. 27, 1994

[86] PCT No.: PCT/EP94/04324

§ 371 Date: Aug. 16, 1996

§ 102(e) Date: Aug. 16, 1996

[87] PCT Pub. No.: WO95/18704

PCT Pub. Date: Jul. 13, 1995

[30] Foreign Application Priority Data

Jan. 10, 1994 [DE] Germany ..... 40 00 272.6
May 30, 1994 [DE] Germany ..... 44 18 807.2

[51] Int. Cl.[6] ..... B28B 7/36; B28B 7/38

[52] U.S. Cl. ..... 106/38.22; 106/2; 106/38.4; 106/38.7; 106/243; 264/213; 264/333; 264/338; 427/133

[58] Field of Search ..... 106/38.22, 38.24, 106/38.7, 243, 244, 2; 427/133; 264/213, 300, 333, 338

[56] References Cited

U.S. PATENT DOCUMENTS 3,354,180 11/1967 Ekiss et al. ..... 364/338
5,100,697 3/1992 Nielsen ..... 427/133
5,374,303 12/1994 Hoorn ..... 106/38.22

FOREIGN PATENT DOCUMENTS 328158 8/1989 European Pat. Off. .
561465 9/1993 European Pat. Off. .
290 439 5/1991 Germany .
1294038 10/1972 United Kingdom .

OTHER PUBLICATIONS

Beton–technologie (Concrete Technology) of the Deutches Beton–Verein e.V., Wiesbaden, 1980 (no month).

Handbuch Bauchemie, Verlag für chem. Industrie, Ziolkowsky AG, Augsburg, 1991, pp. 319 et seq. (no month).

RAL UZ 64 "Biolobisch schnell abbaubare Schmierstoffe und Schalöle (Rapidly Biodegradable Lubricants and Stripping Oils", Jun. 1991.

Prof. Dr. Jürgen Falbe Prof. Dr. Manfred Regitz, Römpp Chemie Lexikon, Georg Thieme Verlag Stuttgart–New York, 1990, p. 1667 (no month).

*Primary Examiner*—Michael Marcheschi
*Attorney, Agent, or Firm*—Wayne C. Jaeschke; John Daniel Wood; Daniel S. Ortiz

[57] ABSTRACT

A composition useful as a release agent for hydraulic binders is provided. The composition comprises water, an oil component comprising a water-immiscible monohydric alcohol component liquid at temperatures of 5° to 15° C. and selected from the group consisting of unsaturated fatty alcohols containing 12 to 22 carbon atoms and having iodine values of 40 to 170, Guerbet alcohols containing 16 to 28 carbon atoms, oxoalcohols containing 8 to 15 carbon atoms, and saturated alcohols containing 6 to 10 carbon atoms, and 0.5 to 5% by weight of an emulsifier, based on the oil component. The release agent is particularly useful for the treatment of formwork material in concrete construction.

21 Claims, No Drawings

RELEASE AGENTS FOR HYDRAULIC BINDERS

RELATED APPLICATION

This application is a 371 of International Application Number PCT/EP94/04324, filed Dec. 27, 1994.

FIELD OF THE INVENTION

This invention is concerned with release agents for hydraulic binders, more especially for concrete formwork and molds, and relates to compositions for this purpose containing water-immiscible monohydric alcohols liquid at temperatures of 5° to 15° C. and emulsifiers in quantities of 0.5 to 5% by weight.

PRIOR ART

Release agents for concrete formwork and molds are known, for example, from the corresponding directive of the Main Committee "Betontechologie (Concrete Technology)" of the Deutches Beton-Verein e.V., Wiesbaden, 1980, or from H. Reul, Handbuch Bauchemie, Verlag für chem. Industrie, Ziolkowsky AG, Augsburg, 1991, pages 319 et seq. They are applied to the formwork before introduction of the fresh concrete. When the formwork is removed, the release agents are intended to reduce adhesion between concrete and formwork and to prevent damage to the surface of the concrete and to the formwork. The number of times the formwork material can be reused is supposed to be increased in this way.

The release agents generally contain an oil component and various additives, for example rustproofing agents, antioxidants, antipore agents, preservatives, wetting agents, adhesion promoters, and emulsifiers. Various classes of substances and mixtures thereof, for example mineral oils or white oils, waxes, triglycerides based on vegetable or animal oils or fats or fat derivatives, are used as the oil component.

For hydraulic binders, the release agents are used with particular advantage in the form of an aqueous emulsion. For this particular application, the release agents generally contain emulsifiers, such as soaps, ethoxylated fatty acids and ethoxylated alkylphenols or petroleum sulfonates in quantities of around 10 to 30% by weight, based on the oil component. The release agents are not normally delivered to the point of use as an emulsion, but instead in the form of a concentrate which is diluted immediately before use.

The release agents in use today have various disadvantages. Mineral oils or white oils are not sufficiently biodegradable as the oil component. Although triglycerides based on native raw materials, for example rapeseed oil, are readily biodegradable, they have relatively high viscosities which are unfavorable for practical application. In addition, saponification of the oil by alkaline constituents of the concrete can result in the precipitation of Ca soaps, a phenomenon known as dust formation, which can cause adhesion problems during subsequent processing of the concrete. Fatty acid esters show similar behavior. It has already been proposed to remedy the situation by using fatty alcohol distillation residues. Unfortunately, it has been found that these compounds can only be partly used as the oil component, as described for example in DD-A5 290 439. According to this document, the oil component consists of 80 to 90% by weight of mineral oil to which 4 to 10% by weight of a mixture of saturated and unsaturated wax esters containing 32 to 36 carbon atoms, saturated and unsaturated fatty alcohols containing 24 to 32 carbon atoms and hydrocarbons of the type obtained as residue in the distillation of fatty alcohols are added. In addition, the wax esters present in the mixture can saponify, thus giving rise to the adhesion problems described above.

GB 1,294,038 describes release agents based on aliphatic, saturated or unsaturated alcohols and a cationic emulsifier. The quantities disclosed in the Examples are well above 10% by weight, based on the fatty alcohol.

EP-A 561 465 proposes emulsifiable release agents for hydraulic binders based on fatty acid esters of polyols which do not contain any H atoms in the β-position to the OH group. Higher aliphatic monohydric alcohols may also be added to the esters. The esters or mixtures thereof with the alcohols are emulsified by addition of an emulsifier. The quantities disclosed in the Examples are at least 7% by weight, based on the mixture of fatty alcohol and ester.

Accordingly, there is an increasing need for an oil component for release agents for hydraulic binders which is biologically degradable without having any of the disadvantages of hitherto known compounds, such as high viscosity, surface defects or dust formation.

The requirements which an ecologically safe concrete release agent is expected to satisfy are set out by way of example in RAL UZ 64 "Biolobisch schnell abbaubare Schmierstoffe und Schaläe (Rapidly Biodegradable Lubricants and Stripping Oils)", June 1991.

The emulsifiers used for the preparation of aqueous emulsions are also problematical from the applicational point of view. Hitherto, relatively large quantities of emulsifier have had to be used for the preparation of the emulsions which unfortunately has an adverse effect on the resistance of the release agents to rain. In addition, high emulsifier contents can lead to re-emulsification at the interface with the alkaline cement, part of the release agent penetrating into the surface of the concrete. These residues of release agent can then lead to the above-mentioned problems in regard to the adhesion of paints or plasters.

The problem addressed by the present invention was to provide release agents for hydraulic binders of which the oil components contain monohydric, water-immiscible alcohols which are liquid at temperatures of 5° to 15° C. and which are not attended by the disadvantages of compounds hitherto known for this purpose, such as dust formation, surface defects and adhesion problems, which arise partly out of the fact that the native oils used are not resistant to saponification. Where formwork material of steel is used, the release agents should not produce any signs of corrosion. Another problem addressed by the present invention was to provide release agents for hydraulic binders of which the oil components would contain monohydric, water-immiscible alcohols liquid at temperatures of 5° to 15° C. and which would form stable emulsions even at temperatures of 0° to −5° C., optionally in the presence of small quantities of emulsifiers. The viscosity of the emulsions would have to be low enough for problem-free spraying. In addition, uniform wetting coupled with firm adhesion to various formwork materials would have to be guaranteed.

DESCRIPTION OF THE INVENTION

The present invention relates to release agents for hydraulic binders which are characterized in that they contain a) a water-immiscible monohydric alcohol component liquid at temperatures of 5° to 15° C. from the group of unsaturated fatty alcohols containing 12 to 22 carbon atoms and having iodine values of 40 to 170 and/or Guerbet alcohols containing 16 to 28 carbon atoms and/or oxoalcohols containing 8 to 15 carbon atoms and/or saturated alcohols containing 6 to 10 carbon atoms, b) if desired, other water-immiscible organic compounds, a) and b) forming the oil component, c) if desired, other auxiliaries typically present in release agents for hydraulic binders, d) water and e) 0.5 to 5% by weight of an emulsifier, based on the oil component.

The present invention also relates to the use of the release agents for the treatment of formwork material in concrete construction.

Hydraulic Binders

Hydraulic binders are mineral substances which harden like stone by taking up water and which, after curing, are resistant to water. A preferred hydraulic binder is concrete.

Oil Component

It has been found that monohydric, water-immiscible alcohols liquid at temperatures of 5° to 15° C. can be emulsified particularly easily. Emulsification takes place without any need for an emulsifier to be added. The quality of the emulsions can be distinctly improved by addition of small quantities of emulsifiers.

In the context of the invention, water-immiscible alcohols are understood to be alcohols of which the solubility in water at 20° C. is below 5% by weight.

Liquid at temperatures of 5° to 15° C. means that the alcohols or mixtures of alcohols according to the invention are movable, flowable liquids at those temperatures.

It has been found that higher alcohols from the class of unsaturated fatty alcohols, Guerbet alcohols, oxoalcohols and saturated alcohols containing 6 to 10 carbon atoms are particularly suitable for the purposes of the invention.

The unsaturated alcohols used in accordance with the invention are compounds known per se which are obtainable by partial hydrogenation of fats or fatty acid methyl esters. The fats and oils used as the raw material base are not pure chemical compounds, instead their fatty acids have a C chain distribution and may be present in saturated or mono- or polyunsaturated form. Accordingly, the fatty alcohols produced from them also have a C chain distribution and may contain saturated, mono- or polyunsaturated species.

The unsaturated fatty alcohols may consist of 12 to 22 and preferably 16 to 18 carbon atoms and may have iodine values of 40 to 170 and preferably 70 to 100. Fats and oils of vegetable and animal origin, for example palm kernel oil, coconut oil, tallow, rapeseed oil, soybean oil, palm oil and sunflower oil, are used as the raw material base. It is of particular advantage to use an unsaturated fatty alcohol based on tallow, sunflower oil with an oleic acid content of more than 80% by weight and/or rapeseed oil which may be used even without distillation.

Guerbet alcohols may also be used in accordance with the invention. Guerbet alcohols are obtainable by the known alkali-catalyzed condensation of aliphatic alcohols at temperatures of around 200° C. Alcohols containing 8 to 22 carbon atoms may be introduced into the condensation reaction. Linear alcohols containing 8 to 14 carbon atoms are preferably used for the condensation reaction which leads to the Guerbet alcohols containing 16 to 28 carbon atoms preferably used.

In addition, so-called oxoalcohols may also be used. Oxoalcohols are generally primary, partly branched higher alcohols which are obtained in the oxosynthesis. In this synthesis, aldehydes obtained by addition of carbon monoxide onto olefins are reduced with hydrogen to alcohols, for example alcohols containing 8 to 15 carbon atoms.

Finally, saturated alcohols containing 6 to 10 carbon atoms based on native or synthetic raw materials may also be used.

The oil components described above may be used as release agents for hydraulic binders, optionally after the addition of additives known to the expert for this purpose, including for example rustproofing agents, antioxidants, antipore agents, preservatives, wetting agents and adhesion promoters.

In addition to the alcohols according to the invention, the oil component may also contain other oils suitable for this purpose in small quantities of up to 15% by weight, including fatty acid esters, for example 2-ethylhexyl stearate, fatty ethers derived from linear fatty alcohols, such as di-n-octyl ether, triglycerides and—although not preferred—mineral oil.

If the oil component is to be used in the form of an emulsion, emulsifiers may also be added.

Emulsifier

Surprisingly, the oil components according to the invention may be converted into stable emulsions by the addition of up to 5% by weight, based on the oil component, of suitable emulsifiers.

To produce the release agents according to the invention for hydraulic binders, the emulsifiers are added in quantities of 0.5 to 5% by weight and preferably in quantities of 0.5 to 3% by weight, based on the oil component.

Suitable emulsifiers are the w/o and o/w emulsifiers known per se, including nonionic emulsifiers, such as for example ethoxylates of fatty alcohols or alkylphenols, ethoxylates of fatty acids, fatty acid monoglycerol esters, alkanolamides; and anionic emulsifiers, for example sulfonates, such as for example oleic acid sulfonate, sulfosuccinates, amide ether sulfates, such as the sulfate of oleic acid ethanolamide, betaines, soaps of fatty acids or resinic acids and the like. Cationic emulsifiers, such as for example fatty amines or ethoxylated fatty amines—neutralized for example with lactic acid or acetic acid—or quaternary ammonium compounds, may also be used.

The quality of the emulsions formed, above all in regard to their resistance to creaming or thickening, is determined by the type and quantity of emulsifier used. With one particular emulsifier system, stability can be improved by increasing the percentage content of emulsifier. However, it has been found that there is no advantage in using large quantities of an extremely effective emulsifier because the release effect deteriorates significantly with relatively large quantities. In order, therefore, to achieve an optimal release effect, an effective emulsifier has to be used in the minimum quantity with which a stable emulsion can still be prepared. Stability in this context means that the emulsion neither creams nor thickens for at least 6 months and, better yet, for 1 year at room temperature. Variations in temperature occur during storage and transport of the emulsions and should also not affect their stability. Accordingly, it is desirable that the emulsions should be stable to short-term variations in temperature between 5° and 40° C., i.e. should neither cream up nor thicken.

The sodium or potassium soaps of saturated or unsaturated fatty acids containing 12 to 22 carbon atoms, for example sodium stearate or potassium oleate, are particularly suitable.

In practice, concentrates of concrete release agents are often diluted with tap water of varying hardness. If the concentrates are to be stable against dilution with tap water of varying hardness, it is preferred to use nonionic emulsifiers.

In one preferred embodiment of the invention, ethoxylated castor oils obtained by addition of 5 to 50 moles and preferably 5 to 20 moles of ethylene oxide (EO) per mole of triglyceride are used as nonionic emulsifiers.

In another preferred embodiment of the invention, α-epoxides containing 8 to 18 and preferably 12 to 14 carbon atoms ring-opened with polyhydric alcohols, preferably ethylene glycol, and subsequently reacted with 5 to 25 and preferably 7 to 15 moles of ethylene oxide per mole of α-epoxide are used as nonionic emulsifiers.

In another preferred embodiment of the invention, saturated or unsaturated fatty alcohols containing 8 to 18 and preferably 10 to 14 carbon atoms which have been reacted with 5 to 50 and preferably 7 to 15 moles of ethylene oxide are used as nonionic emulsifiers.

In another preferred embodiment of the invention, fatty alcohols containing 8 to 18 and preferably 10 to 14 carbon atoms, which have been reacted with mixtures of 1 to 10 and preferably 3 to 7 moles of ethylene oxide and 1 to 5 and preferably I to 3 moles of propylene oxide (PO), are used as nonionic emulsifiers.

In another preferred embodiment of the invention, fatty acids containing 8 to 22 and preferably 10 to 18 carbon atoms, which have been reacted with 5 to 15 moles of ethylene oxide, are used as nonionic emulsifiers.

In another preferred embodiment of the invention, fatty acid alkanolamides containing 8 to 22 and preferably 10 to 18 carbon atoms, which have been reacted with 5 to 15 moles of ethylene oxide, are used as nonionic emulsifiers.

In another preferred embodiment of the invention, esters of sorbitan or sorbitan ethoxylated with up to 40 moles with fatty acids containing 12 to 22 carbon atoms are used as nonionic emulsifiers.

Mixtures of emulsifiers, for example anionic and nonionic emulsifiers, can also provide favorable results. Particularly advantageous results can be obtained with mixtures of nonionic emulsifiers, for example with mixtures of ethoxylated castor oil and an ethoxylated reaction product of an α-epoxide and ethylene glycol.

Stable emulsions, which remain stable even at low temperatures of 0° C. to −5° C., can be prepared by emulsification in water. An improvement in low-temperature stability can be obtained by measures known per se, such as the addition of glycerol, polyols, for example sorbitol, or water-soluble polyacrylates in quantities of 0.05 to 0.5% by weight and preferably in quantities of 0.1 to 0.2% by weight, based on the emulsion.

If necessary, the stability of the emulsions can also be increased by addition of protective colloids, for example polyvinyl alcohol or xanthan.

The emulsions prepared from the release agents according to the invention for hydraulic binders may have a solids content of 5 to 55% by weight and preferably 20 to 40% by weight. The emulsions thus prepared are thin-flowing to viscous and contain water as their continuous phase.

The release agents according to the invention for hydraulic binders may also be formulated as highly viscous pastes in the form of water-in-oil emulsions by measuring the quantity of water added in such a way that pastes with a solids content of 60 to 85% by weight and preferably 70 to 80% by weight are formed.

Additives

In addition to the oil component and the emulsifiers, the release agents according to the invention for hydraulic binders may contain typical additives, such as rustproofing agents, antioxidants, antipore agents, preservatives, protective colloids, stabilizers, wetting agents, foam inhibitors and adhesion promoters, in quantities of up to 15% by weight, based on the release agent as a whole without water.

Rustproofing Agents

If the release agents according to the invention for hydraulic binders are to be used for formwork material of steel, it is advisable to use a rustproofing agent as additive to prevent corrosion of the formwork material.

Various compounds may be used as rustproofing agents or corrosion inhibitors.

One group of rustproofing agents according to the invention are, for example, the amines, for example octylamine, tridecylamine, dibutylamine, tributylamine, dimethyl alkylamines containing 8 to 18 carbon atoms in the alkyl chain, or diamines, such as ethylenediamine, 1,2-propylenediamine, diethylenetriamine and—preferably—alkanolamines, such as ethanolamine, diethanolamine, triethanolamine, 1-amino-2-propanol, diisopropanolamine, triisopropanolamine, methyl ethanolamine, dimethyl ethanolamine, aminoethyl ethanolamine, ethyl ethanolamine and diethyl ethanolamine, which have a corrosion-inhibiting effect, particularly on iron or iron-containing alloys.

Another group of effective compounds are anionic compounds, such as sodium, potassium or amine soaps of fatty acids, preferably containing 6 to 10 carbon atoms, of dimer fatty acid or the corresponding compounds of aromatic mono- or dicarboxylic acids, for example benzoic or phthalic acid.

The alkali metal or amine salts of acidic phosphoric acid esters with alcohols containing 6 to 18 carbon atoms or phosphoric acid salts, such as trisodium phosphate, are also rustproofing agents in the context of the invention.

Another group of corrosion-inhibiting compounds which may be used in accordance with the invention are the amides of fatty acids or dimeric fatty acids with alkanolamines, such as monoethanolamine or diethanolamine, monopropanolamine or dipropanolamine, or diamines, such as ethylenediamine, 1,3-propylenediamine, 1,2-propylenediamine, or diethylenetriamine. The amidoamines just mentioned may be neutralized with acids, such as lactic acid. The monoethanolamides of saturated and unsaturated fatty acids containing 16 to 20 carbon atoms are preferably used, the ethanolamide of oleic acid or linoleic acid or technical mixtures of these fatty acids being particularly preferred. Compounds from the class of triazoles, for example benzotriazole or tolyl triazole, also have a corrosion-inhibiting effect.

Since the various corrosion inhibitors can also have a synergistic effect, mixtures of the compounds mentioned above may also be used.

The quantities of rustproofing agent added are between 0.01 and 2% by weight and preferably between 0.1 and 1.0% by weight, based on the release agent as a whole without water.

The rustproofing agents may be incorporated in the water-free release agent for hydraulic binders providing they are soluble therein. The rustproofing agents may also be introduced into the water required to emulsify the release agents for hydraulic binders or, after emulsification, into the emulsion itself.

Production

The release agents are produced by thoroughly mixing the oil component with the emulsifier and, optionally, the additives. This so-called concentrate may be used either directly or after emulsification in water.

The concentrates from which the emulsions are prepared contain at least 68% by weight of the alcohol component, up to 15% by weight of other water-immiscible organic compounds, 0.5 to 5% by weight of an emulsifier and up to 15% by weight of other auxiliaries typically present in release agents for hydraulic binders, the sum total of the constituents of the concentrate amounting to 100% by weight.

Emulsification is preferably carried out by incorporating the concentrate while stirring in water, although water may also be stirred into the concentrate until the required solids content or active substance content is reached.

To prepare aqueous emulsions, it is of advantage to use stirring units which enable intensive shear forces to be applied on the rotor/stator principle, for example a so-called Cavitron or Supraton machine.

To avoid foaming, it can be of advantage to introduce an anti-foam agent during the emulsification or to add an antifoam agent to the release agent from the outset.

Application

The release agents can be applied to the formwork material in various ways in order to facilitate stripping after setting of the hydraulic binder.

The release agents may be applied to the formwork surfaces, for example in pure form or in the form of an emulsion, by spray coating, spreading coating or brush coating. The low-viscosity emulsions are so stable that they can be sprayed without any problems. High-viscosity pastes can even be applied by trowel.

The release agents according to the invention for hydraulic binders may be used either on their own or in the form of aqueous emulsions for the treatment of steel, plastic or wooden formwork in concrete construction. To this end, they may be applied by any of the units normally used.

EXAMPLES

In the Examples, all percentages are by weight, unless otherwise indicated.

Example 1

Production of a Concrete Release Agent

1. Concentrate 990 g of an unsaturated fatty alcohol (C chain distribution 1% C12, 4% C14, 12% C16, 82% C18, 1% C20, iodine value 92.6) were mixed with 10 g of sodium stearate at 100° C. in a stirred vessel, followed by stirring for 10 minutes. 1000 g of a homogeneous concentrate gel-like at room temperature were obtained.

Emulsion 300 g of the concentrate were added with stirring to 700 g of tap water. A milky emulsion was obtained and remained stable to sedimentation or creaming over a period of 4 weeks at room temperature (around 23° C.). The emulsion had a viscosity of 1700 cPs (centiPoises), as determined with a Brookfield viscosimeter, spindle 4, at 23° C.

Emulsion Concentrate 500 g of the concentrate and 500 g of tap water were stirred in a high-speed stirrer to form a milky viscous emulsion. The emulsion had a viscosity of 3200 cPs, as determined with a Brookfield viscosimeter, spindle 4, at 23° C.

The emulsion concentrate may be converted into stable emulsions with solids contents of 5 to 40% by weight simply by stirring with more tap water.

Further Examples are set out in Table 1.

TABLE 1

Composition and Behavior of Concrete Release Agents

| | | | Emulsion | |
|---|---|---|---|---|
| Ex. | Oil Component | Quantity of Emulsifier | Solids Content [% by weight] | Behavior |
| 2 | A | — | 30 | Iv, stable |
| 3 | A | 1% Na stearate | 70 | Paste |
| 4 | A | 0.5% Na stearate | 30 | Iv, stable |
| 5 | B | 1% Na stearate | 30 | Iv, stable |
| 6 | B | 0.5% Na stearate | 30 | Iv, stable |
| 7 | B | 1% Na stearate | 50 | Paste |
| 8 | C | 1% Na stearate | 30 | Iv, stable |
| 9 | A | 1% K oleate | 30 | Iv, stable |
| 10 | A | 1% Tallow fatty alcohol.5EO | 30 | Iv, stable |
| 11 | B | 1% Tallow fatty alcohol.5EO | 30 | Iv, stable |
| C1 | D | 1% Na stearate | 30 | Thickened |
| C2 | D | 3% Na stearate | 30 | Thickened |
| C3 | D | 3% Na Stearate | 10 | Thickened |

Legend:
Iv stands for low viscosity.

Oil component A is an unsaturated fatty alcohol with a C-chain distribution of 1% C12, 4% C14, 12% C16, 82% C18, 1% C20 and with an iodine value of 92.6, as determined by method C V 11 b of the Deutsche Gesellschaft f ür Fettforschung.

Oil component B is an unsaturated fatty alcohol with a C-chain distribution of 1% C12, 2% C14, 8% C16, 87% C18, 2% C20 and with an iodine value of 95.1, as determined by method C V 11 b of the Deutsche Gesellschaft for Fettforschung.

Oil component C is a Guerbet alcohol containing 16 carbon atoms.

Oil component D (comparison) is a mixture of saturated fatty alcohols with an iodine value of <0.5 and the following C chain distribution: 1% C10, 54% C12, 23% C14, 10% C16 and 12% C18.

The tests show that stable sprayable emulsions can only be prepared with the fatty alcohols and Guerbet alcohols according to the invention. With a solids content of 70%, a highly viscous paste is obtained and may either be applied by trowel or may be converted into a low-viscosity emulsion by dilution to a solids content of 30%. The comparison tests with the saturated fatty alcohol produce a thickened highly viscous emulsion, which cannot be sprayed, despite an increase in the quantity of emulsifier used and a reduction in the solids content.

Example 12

Testing of Low-Temperature Stability

The emulsion prepared in accordance with Example 1 was cooled to −5° C. The emulsion remained stable up to that temperature.

Example 13

Application Test

The emulsion prepared in accordance with Example 1 was sprayed onto vertical surfaces of construction steel. A uniform oil film with good adhesion was obtained. After the surface had been sprayed down with tap water, the oil film remained largely intact.

Example 14

Testing of Release Effect

A mold of shuttering boards was sprayed with the emulsion prepared in accordance with Example 1 and filled with concrete. After setting, the formwork could be removed without difficulty. The structure of the wood was clearly visible on the concrete surface. There were no signs of dust formation or other surface defects. The test was repeated up to 10 times with the same shuttering boards without any deterioration in the release effect.

Example 15

Concrete Release Agents Containing Rustproofing Agent

Emulsion 300 g of the concentrate of Example 1 were added with stirring to a mixture of 698 g of deionized water to which 2 g of rustproofing agent had been added. A milky emulsion was obtained and remained stable to sedimentation and creaming over a period of 4 weeks at room temperature (around 23° C.). The emulsion had a viscosity of 1700 cPs (centiPoises), as determined with a Brookfield viscosimeter, spindle 4, at 23° C.

Examples of the rustproofing agents are set out in Table 2.

TABLE 2

Rustproofing Agents

| Ex. | Rustproofing Agent |
|---|---|
| a | Trisodium phosphate, $Na_3PO_4$ |
| b | N-(2-aminoethyl)-ethanolamine |
| c | TEXAMIN ® KE 3160 |
| d | TEXAMIN ® KE 3161 |

TEXAMIN® KE 3160 is a rustproofing agent of Henkel KGaA consisting of a mixture of fatty acid monopropanolamide, alkanolamines and short-chain fatty acids.

TEXAMIN® KE 3161 is a rustproofing agent of Henkel KGaA which consists of a mixture of fatty acid monoethanolamide, alkanolamines and short-chain fatty acids.

Test for Corrosion-Inhibiting Effect

A plate of non-alloyed steel (St 37-2) was sprayed with the concrete release agents of Examples a to d according to the invention. A plate sprayed with a concrete release agent emulsion with no rustproofing agent (Comp. 1 ) and a plate sprayed with deionized water (Comp. 2) were tested for comparison.

The moistened plates were visually examined for rusting at certain time intervals.

TABLE 3

Results of the Corrosion Test

| | Rust After | | | | |
|---|---|---|---|---|---|
| Example | 1 h | 2 h | 8 h | 24 h | 48 h |
| a | None | None | None | None | None |
| b | None | None | None | None | None |
| c | None | None | None | None | None |
| d | None | None | None | None | None |
| Comp. 1 | Slight | Slight | Serious | Serious | Serious |
| Comp. 2 | Slight | Slight | Slight | Serious | Serious |

Application Test

The emulsion prepared in accordance with Example 15a was sprayed into a mold of construction steel. The mold was filled with concrete. After setting, the formwork could be removed without difficulty and without any sign of dust formation on the concrete.

Example 16

Selection of Nonionic Emulsifiers

To select suitable nonionic emulsifiers, 970 g of an unsaturated fatty alcohol (oil component A) were mixed with 30 g of the nonionic emulsifier in a stirred vessel, followed by stirring for 10 minutes.

300 g of the concentrate were emulsified for 5 minutes in 700 g of tap water in an Ultraturrax.

TABLE 4

Nonionic Emulsifiers

| Emulsifier | Emulsion |
|---|---|
| $C_{10-14}$ fatty alcohol × 1 PO, 6 EO | Stable |
| Unsaturated $C_{16-18}$ fatty alcohol × 6 EO | " |
| Tall oil fatty acid × 5 EO | " |
| Cocofatty acid × 9 EO | " |
| Castor oil × 5 EO | " |
| Castor oil × 11 EO | " |
| Castor oil × 20 EO | " |
| $C_{12-14}$ α-epoxide + ethylene glycol × 10 EO | " |
| Sorbitan monooleate × 20 EO | " |
| 1 P castor oil × 11 EO | " |
| 1 P $C_{12-14}$ α-epoxide + ethylene glycol × 10 EO | " |

When the emulsifier mixture is used, no gel phase occurs during emulsification in contrast to the use of pure emulsifiers.

What is claimed is:

1. A release agent for hydraulic binders, comprising:

(1) optionally water; and (2) a component comprising:

(a) at least 68% by weight of at least one water-immiscible monohydric alcohol, liquid at temperatures of between 5° C. to 15° C., selected from the group consisting of unsaturated fatty alcohols containing 12 to 22 carbon atoms and having an iodine value of 40 to 170, Guerbet alcohols containing 16 to 28 carbon atoms, oxoalcohols containing 8 to 15 carbon atoms, and saturated alcohols containing 6 to 10 carbon atoms;

(b) up to 15% by weight of water-immiscible organic compounds different from (a), wherein (a) and (b) form an oil component;

(c) 0.5 to 5% by weight of an emulsifier.

2. The composition as claimed in claim 1 consisting essentially of 15 to 55% by weight of the component and 85 to 45% by weight of water.

3. The composition as claimed in claim 1 wherein said water-immiscible monohydric alcohol, liquid at temperatures of 5° to 15° C., is an unsaturated fatty alcohol containing 16 to 18 carbon atoms and having an iodine value of 70 to 100.

4. The composition as claimed in claim 1 wherein said emulsifier is present in a quantity of 0.5 to 3% by weight, based on the component.

5. The composition as claimed in claim 1 wherein said emulsifier is a soap of a saturated or unsaturated fatty acid containing 12 to 22 carbon atoms.

6. The composition as claimed in claim 1 wherein said emulsifier is a nonionic emulsifier.

7. The composition as claimed in claim 1 wherein said emulsifier is a mixture of emulsifiers.

8. The composition as claimed in claim 1 further comprising at least one auxiliary comprising rustproofing agents, antioxidants, antipore agents, preservatives, protective colloids, stabilizers, wetting agents, foam inhibitors or adhesion promoters.

9. The composition as claimed in claim 1 further comprising a rustproofing agent selected from the group consisting of amines, alkanolamines, fatty acid salts, salts of acidic phosphoric acid esters, phosphoric add salts and amides of fatty acids.

10. The composition as claimed in claim 9 wherein said rustproofing agent is present in a quantity of 0.01 to 2% by weight based on the component.

11. The composition as claimed in claim 9 wherein said rustproofing agent is present in a quantity of 0.1 to 1% by weight based on the component.

12. The composition as claimed in claim 1 wherein said component further comprises a water-immiscible organic compound selected from the group consisting of fatty acid esters, fatty ethers, triglycerides, and mineral oils.

13. The composition as claimed in claim 1 comprising:

a) at least 68% by weight of at least one water-immiscible monohydric alcohol, liquid at temperatures of 5° to 15° C., selected from the group consisting of unsaturated fatty alcohols containing 12 to 22 carbon atoms and having an iodine value of 40 to 170, Guerbet alcohols containing 16 to 28 carbon atoms, oxoalcohols containing 8 to 15 carbon atoms, and saturated alcohols containing 6 to 10 carbon atoms, b) up to 15% by weight of water-immiscible organic compounds, which are different from (a), and c) 0.5 to 5% by weight of an emulsifier.

14. A release agent for hydraulic binders, comprising:

from 85 to 45% by weight of water, a component consisting essentially of at least one water-immiscible monohydric alcohol, liquid at temperatures of 5° to 15° C., selected from the group consisting of unsaturated fatty alcohols containing 12 to 22 carbon atoms and having an iodine value of 40 to 170, Guerbet alcohols containing 16 to 28 carbon atoms, oxoalcohols containing 8 to 15 carbon atoms, and saturated alcohols containing 6 to 10 carbon atoms, 0.5 to 5% by weight of an emulsifier, based on the component, and a rustproofing agent selected from the group consisting of amines, alkanolamines, fatty acid salts, salts or acidic phosphoric acid esters, phosphoric acid salts and amides of fatty acids in a quantity of 0.01 to 2% by weight based on the component.

15. The composition as claimed in claim 14 wherein said water-immiscible monohydric alcohol, liquid at temperatures of 5° to 15° C., is an unsaturated fatty alcohol containing 16 to 18 carbon atoms and having an iodine value of 70 to 100.

16. In a method of treating a mold with a release agent, the improvement comprising using as the release agent, a composition as claimed in claim 1.

17. A method for facilitating the release of a hydraulic binding material from a mold comprising applying a composition as claimed in claim 1 to a surface of a mold for concrete, introducing fresh concrete into said mold, permitting the hydraulic binding material to set or cure and removing the set or cured binding material from the mold.

18. The method as claimed in claim 17 wherein said water-immiscible monohydric alcohol, liquid at temperatures of 5° to 15° C., is an unsaturated fatty alcohol containing 16 to 18 carbon atoms and having an iodine value of 70 to 100.

19. The method as claimed in claim 17 wherein said composition further comprises a rustproofing agent selected from the group consisting of amines, alkanolamines, fatty acid salts, salts of acidic phosphoric acid esters, phosphoric acid salts and amides of fatty acids.

20. The method as claimed in claim 17 wherein said release agent comprises:

from 85 to 45% by weight of water, a component consisting essentially of at least one water-immiscible monohydric alcohol, liquid at temperatures of 5° to 15° C., selected from the group consisting of unsaturated fatty alcohols containing 12 to 22 carbon atoms and having an iodine value of 40 to 170, Guerbet alcohols containing 16 to 28 carbon atoms, oxoalcohols containing 8 to 15 carbon atoms, and saturated alcohols containing 6 to 10 carbon atoms, 0.5 to 5% by weight of an emulsifier, based on the component, and a rustproofing agent selected from the group consisting of amines, alkanolamines, fatty acid salts, salts of acidic phosphoric acid esters, phosphoric acid salts and amides of fatty acids in a quantity of 0.01 to 2% by weight based on the component.

21. The method as claimed in claim 20 wherein said water-immiscible monohydric alcohol, liquid at temperatures of 5° to 15° C., is an unsaturated fatty alcohol containing 16 to 18 carbon atoms and having an iodine value of 70 to 100.

* * * * *